United States Patent [19]

Marchbank

[11] 4,058,215

[45] Nov. 15, 1977

[54] FRAMED EMBROIDERY ASSEMBLY

[75] Inventor: Ian Marchbank, Barnt Green, England

[73] Assignee: Abel Morrall Limited, England

[21] Appl. No.: 619,307

[22] Filed: Oct. 3, 1975

[30] Foreign Application Priority Data

Oct. 24, 1974 United Kingdom ..... 46153/74

[51] Int. Cl.[2] ..... B65D 69/00; D06C 3/08; G09F 1/10

[52] U.S. Cl. ..... 206/574; 38/102.1; 428/13; 40/158 R; 223/109 R; 160/135; 206/575

[58] Field of Search ..... 38/102.1, 102.2; 428/13; 40/158 R; 223/109; 160/135; D3/9 R, 19 R, 19 A; 206/574, 575, 527

[56] References Cited

U.S. PATENT DOCUMENTS

| | | | |
|---|---|---|---|
| 406,340 | 7/1889 | Day | 223/109 R |
| 646,525 | 4/1900 | Knight | 40/158 R |
| 1,200,052 | 10/1916 | Trover | 38/102.1 |
| 3,701,207 | 10/1972 | Conrad | 428/13 |

*Primary Examiner*—William Price
*Assistant Examiner*—Douglas B. Farrow
*Attorney, Agent, or Firm*—Scrivener, Parker, Scrivener & Clarke

[57] ABSTRACT

A framed textile fabric assembly for use in embroidery is disclosed. The assembly includes an open peripheral frame having a textile fabric fixedly secured across the frame. The user embroiders any desired pattern onto the fabric and then quickly and easily obtains a picture framed work by fitting a member across the back of the frame. A pleasing three-dimensional effect to the embroidered work is obtained by inserting a resilient pad between the embroidered textile fabric and the member.

9 Claims, 3 Drawing Figures

FRAMED EMBROIDERY ASSEMBLY

This invention relates to a framed textile fabric assembly for use in embroidery.

For doing embroidery a frame is used to hold the textile fabric taut. When the embroidery has been completed the embroiderer would often like to have it framed but is put off by the trouble and expense involved.

The present invention provides means serving both purposes and consists in a framed textile fabric assembly comprising an open peripheral frame, a textile fabric secured across the frame, a back member adapted to be fitted to the frame behind the textile fabric and a resilient pad adapted to be interposed between the textile fabric and the back member so as to support the textile fabric.

The open frame supports the textile fabric while it is embroidered.

Some textile fabrics become stretched during embroidering so that the finished article may hang loosely in the frame. The resilient pad, for example of foam plastics, is provided between the textile fabric and the back to take up the slack in the textile fabric and indeed enhances the appearance of the finished product by giving a threedimensional effect. When the needlework is finished the pad is placed on the back of the textile fabric and the back is secured to the frame thereby completing the picture frame.

In one form of the invention the open frame is a moulding in toughened polystyrene, although any plastics material which can be moulded to give a rigid frame would be acceptable.

Figure 1:
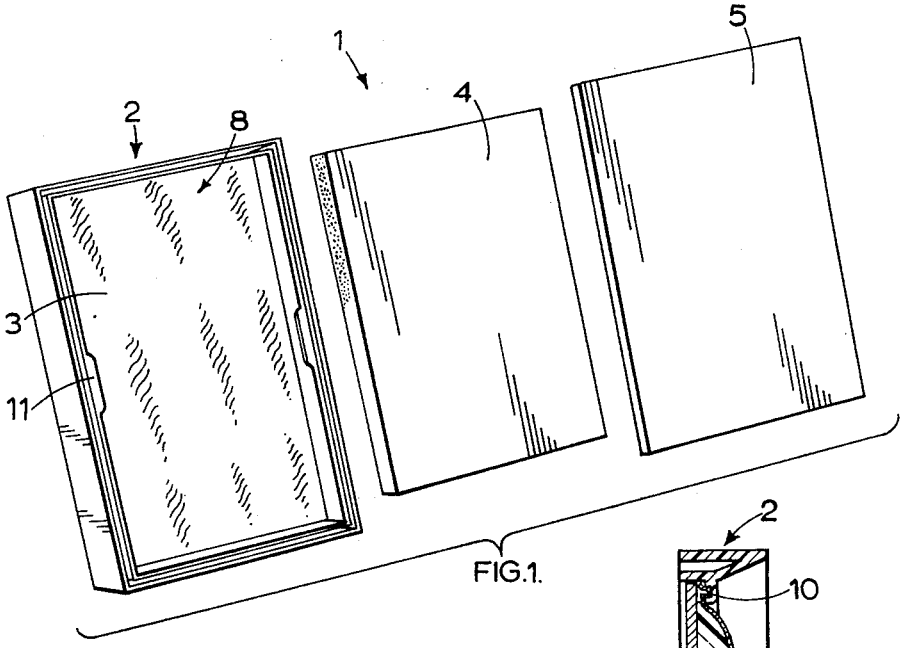
Figure 2:
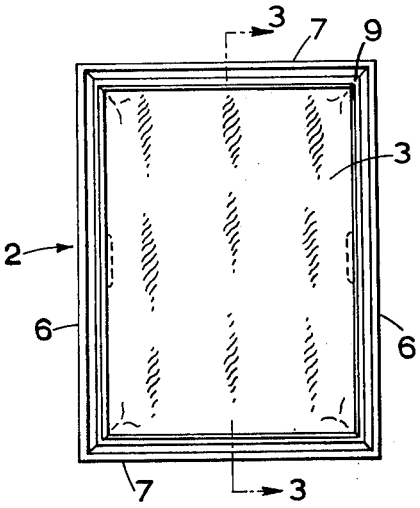
Figure 3:
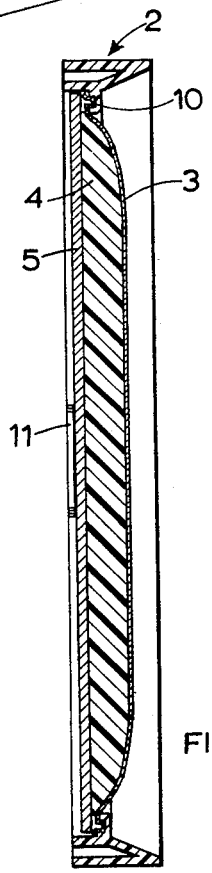

One embodiment of the invention will now be described with reference to the accompanying drawings in which:

FIG. 1 is an exploded perspective view of the components comprising a framed textile fabric assembly according to the invention, FIG. 2 is a plan view of the assembled frame assembly shown in FIG. 1, and FIG. 3 is a section on the line 3—3 of FIG. 2 on a larger scale.

With reference to the accompanying drawings the assembly 1 comprises an integrally moulded rectangular open frame 2 with a textile fabric 3 secured thereto, a resilient pad 4 and a back member 5.

The frame 2 comprises two side members 6 and two end members 7 and is made from a suitable thermoplastic material, such as toughened polystyrene. The side and end members are of narrow Vee cross-section so as to be hollow at the back for convenience and economy in moulding. The frame 2 has an internal rebate 8, open to the rear, formed by a narrow internal flange 9. Canvas, or other suitable textile fabric 3 is stretched across the frame 2 and secured to the rear face of the flange 9 by pressing the fabric 3 against the flange 9 by the edge of an electrically heated frame (not shown) of an outline which overlies the flange 9 and formed from several suitably arranged blades or a single continuous blade bent to the required outline. The blade forms a groove 10 in the flange 9 by melting the thermoplastics under the fabric 3 in contact with the blade. The melted thermoplastics penetrates the weave of the fabric 3 and on removal of the blade the thermoplastics hardens fixing the fabric 3 in the groove 10. The fixing operation also serves to tension the fabric 3 by stretching it into the groove 10 as it is formed. Alternatively the fabric 3 may be attached to the rebate 8 behind the flange 9 by any other suitable means, for example by securing the fabric 3 to the rear face of the flange 9 by use of a suitable adhesive.

Retaining tabs 11 for the back 5 are formed integrally with the moulded frame on the side members 6 and project inwards from opposite sides of the rear edge of the frame 2. The tabs 11 are spaced from the rebate 8 so that the back 5 of thick card, hardboard or the like, shaped to fit the rebate 8 can be slid under the retaining tabs 11 into the rebate 8 and held there. Before the back is fitted the pad 4 of resilient, polyurethane foam, smaller than the frame opening, is placed against the back of the textile fabric 3 followed by a sheet of paper or other suitable material (not shown) which will allow the back 5 to slide easily over the surface of the foam pad 4. As best seen in FIG. 3 when the back is fixed to the frame the pad 4 takes up any slack in the textile fabric 3.

The back 5 may be provided with a prop or the back or frame may have picture rings or other suitable known means of support for display (not shown).

I claim:

1. A framed textile fabric assembly comprising a peripheral frame surrounding a central opening, the frame being made of thermoplastics and having an internal flange open to the rear of the frame, a textile fabric having a pattern formed thereon to guide hand embroidery, said textile fabric being permanently secured directly to said frame across said opening and being welded to the rear face of said flange in a groove formed in said rear face during formation of said weld, a back member for releasable fitting to said frame behind said textile fabric and a resilient pad compressible in thickness between said textile fabric and said back member so as to support and tension said textile fabric when said frame, pad and back member are assembled together.

2. A framed textile fabric assembly comprising a peripheral frame surrounding a central opening, a textile fabric having a pattern formed thereon to guide hand embroidery, said textile fabric being permanently secured directly to said frame across said opening with both sides of said fabric being accessible for embroidery through said opening, a back member for releasable fitting to said frame behind said textile fabric, and a resilient pad having a normal thickness greater than the spacing between said fabric and said back member when the latter is fitted to said frame, said pad being compressible in thickness between said textile fabric and said back member so as to support and tension said textile fabric when said frame, pad and back member are assembled together.

3. A framed textile fabric assembly as claimed in claim 2 in which said peripheral frame has an internal rebate open to the rear.

4. A framed textile fabric assembly as claimed in claim 3 in which said rebate is formed by a narrow flange and said textile fabric is secured to said rebate behind said flange.

5. A framed textile fabric assembly as claimed in claim 2 in which retaining tabs suitable for securing said back member to said frame are formed integrally with said frame and project inwards from opposite sides of the rear edge of said frame.

6. A framed textile fabric assembly as claimed in claim 2 in which said frame is integrally moulded from a plastics material.

7. A framed textile fabric assembly as claimed in claim 6 in which said plastics material is toughened polystyrene.

8. As an article of commerce, a do-it yourself framed embroidery picture kit comprising a peripheral picture frame surrounding a central opening, a textile fabric permanently secured directly to said frame across said opening, both sides of said fabric being accessible for embroidery through said opening, a back member for releasable fitting to said frame behind said textile fabric after the textile fabric has been embroidered, and a resilient pad substantially the shape and size of said opening and having a normal thickness greater than the spacing between said fabric and said back member when the latter is fitted to said frame, said pad being compressible in thickness between said textile fabric and said back member so as to support said textile fabric and take up slackness therein caused by the embroidery thereof.

9. The embroidery picture kit as in claim 8 wherein said resilient pad is of foam plastic material.

* * * * *